United States Patent [19]

Bell

[11] Patent Number: 4,690,650

[45] Date of Patent: Sep. 1, 1987

[54] SEA RESCUE KIT FOR DEPLOYMENT FROM A HELICOPTER

[76] Inventor: Larry Bell, 702 Old Sackville Road, Lower Sackville, Nova Scotia, Canada, B4C 2K3

[21] Appl. No.: 876,590

[22] Filed: Jun. 20, 1986

[30] Foreign Application Priority Data

Mar. 11, 1986 [CA] Canada ..... 503,820

[51] Int. Cl.[4] ..... B63C 9/04

[52] U.S. Cl. ..... 441/40; 441/42; 441/83

[58] Field of Search ..... 114/190, 311; 441/80, 441/81, 83–85, 40–42; 244/137 R, 138 R

[56] References Cited

U.S. PATENT DOCUMENTS 2,095,974 10/1937 Finch ..... 441/42
3,036,315 5/1962 Karnow ..... 441/83
3,612,448 10/1971 Frieder ..... 244/138 R
4,639,229 1/1987 Wright et al. ..... 441/83 X

FOREIGN PATENT DOCUMENTS 228999 10/1959 Australia ..... 441/84

*Primary Examiner*—Sherman D. Basinger
*Attorney, Agent, or Firm*—Robert F. Delbridge; Arne I. Fors

[57] ABSTRACT

A sea rescue kit deployable from a helicopter includes a first self-inflating life raft, a second self-inflating life raft, a line connecting the first and second life rafts, and a device associated with the line to retard the line in the water relative to the life rafts to cause the life rafts and line to assume a substantially horseshoe-shaped configuration around a predetermined position in the sea after deployment from a helicopter upwind of the predetermined position.

4 Claims, 5 Drawing Figures

SEA RESCUE KIT FOR DEPLOYMENT FROM A HELICOPTER

This invention relates to sea rescue kits for deployment from helicopters.

When one or more persons are in the sea awaiting rescue, a helicopter is often the first rescue equipment on the scene. In bad weather conditions, for example when wave heights exceed twenty to twenty-five feet, it is difficult to safely rescue individuals from the water with current helicopter or vessel recovery methods. With present-day technology in survival suits, casualties can be kept sufficiently warm to survive in the water for ten to twenty hours. However, most casualties cannot keep from drowning in an angry sea exposed for an extended period of time.

It is therefore desirable to provide a rescue kit which can be deployed from a helicopter to enable the casualties to survive in the sea for an appropriate time. U.S. Pat. No. 3,612,448 (Frieder) describes a system for delivering a load by parachute from an aircraft to a location at sea, but such a system has various disadvantages and in any event is not suitable for deployment from a helicopter.

It is therefore an object of the invention to provide an improved sea rescue kit which can be deployed from a helicopter.

According to the invention, a sea rescue kit deployable from a helicopter comprises a first self-inflating life raft, a second self-inflating life raft, a line connecting the first and second life rafts, and means associated with the line to retard the line in the water relative to the lift rafts to cause the lift rafts and line to assume a substantially horseshoe-shaped configuration around a predetermined position in the sea after deployment from a helicopter upwind of the predetermined position Thus, in practice, the predetermined position will be the location of casualties in the water. After deployment, the sea rescue kit assumes a substantially horseshoe-shaped configuration around the casualties, thereby rendering it fairly easy for the casualties to reach the life rafts.

At least one floatable survival kit may be carried by the line, and the retarding means may comprise at least one sea anchor.

The rescue kit may also include a container in which the first and second life rafts, the line and the retarding means are housed, and means retaining the life rafts, the line and the retarding means in the container, said first and second life rafts, the line and the retarding means being positioned in the container to cause the first life raft, the line, the retarding means and the second life raft to leave the container by gravity and pull of the line when the retaining means is released. Thus, the various items are automatically deployed once the retaining means has been released.

Figure 1:
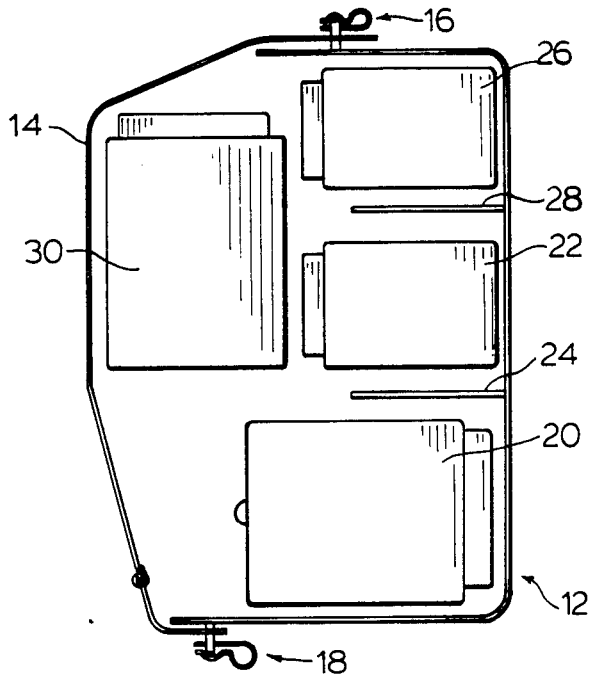
Figure 2:
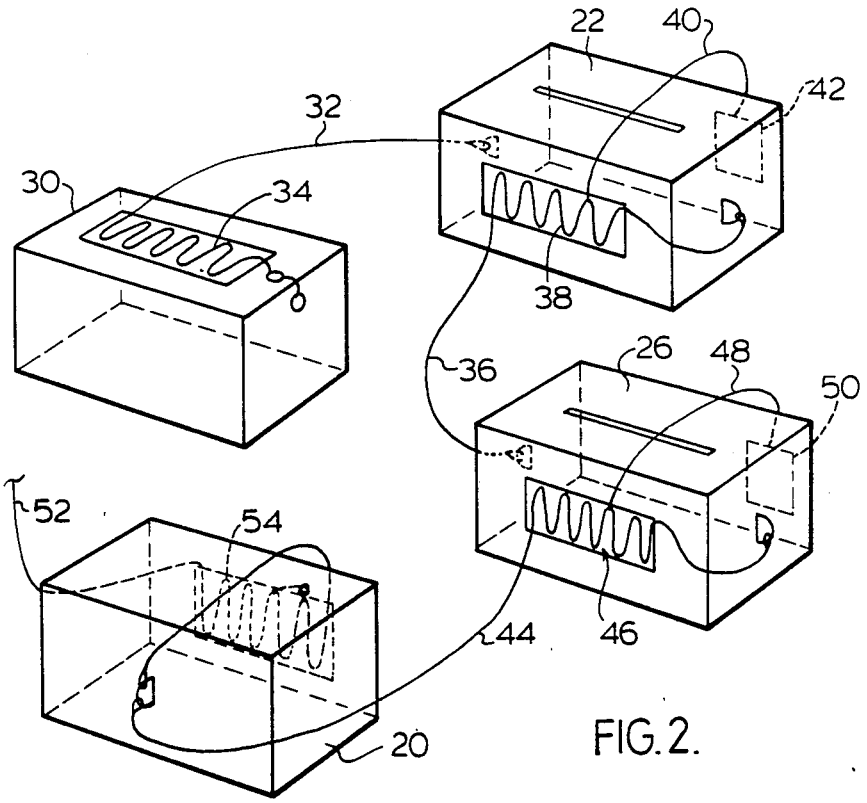
Figure 3:
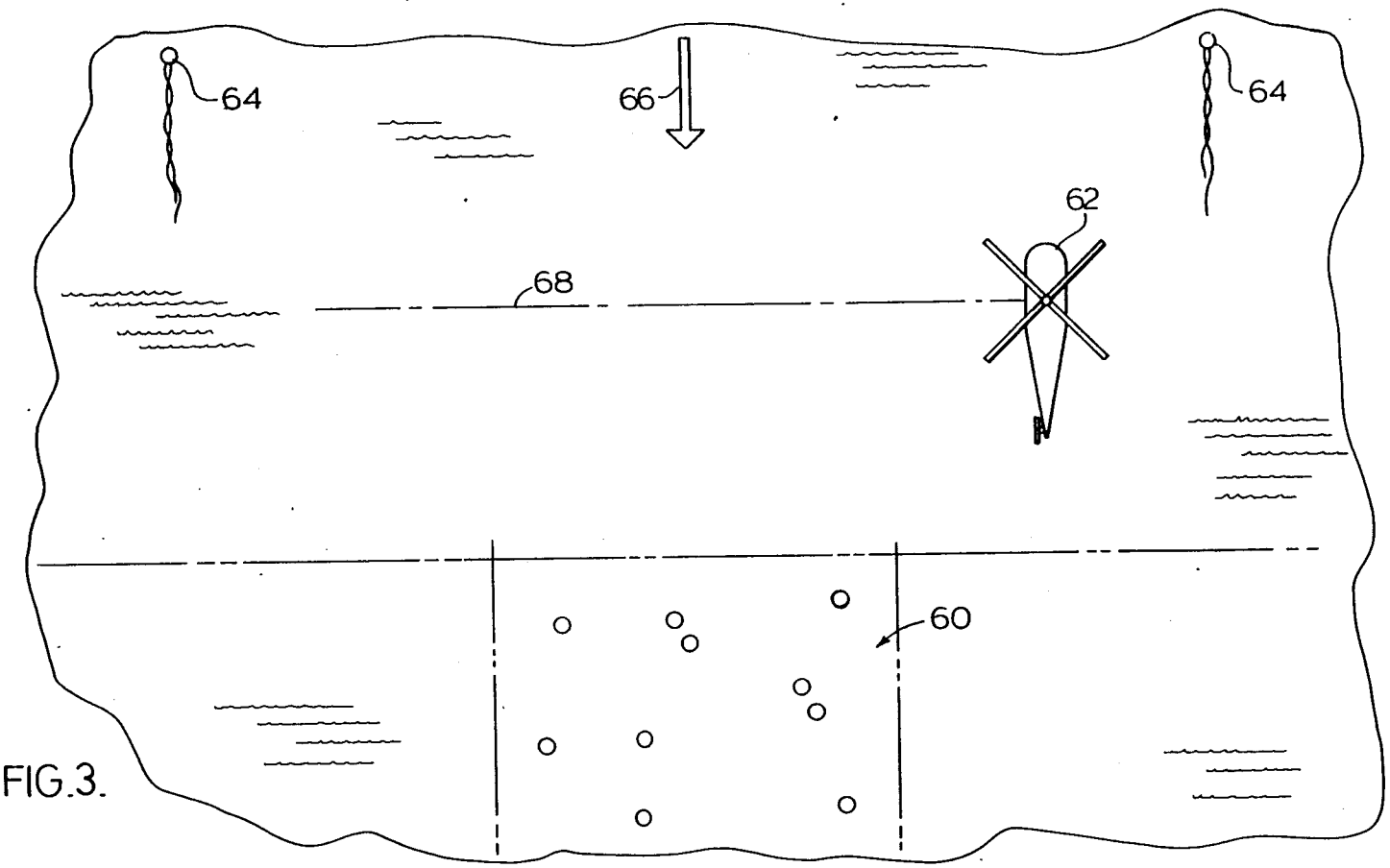
Figure 4:
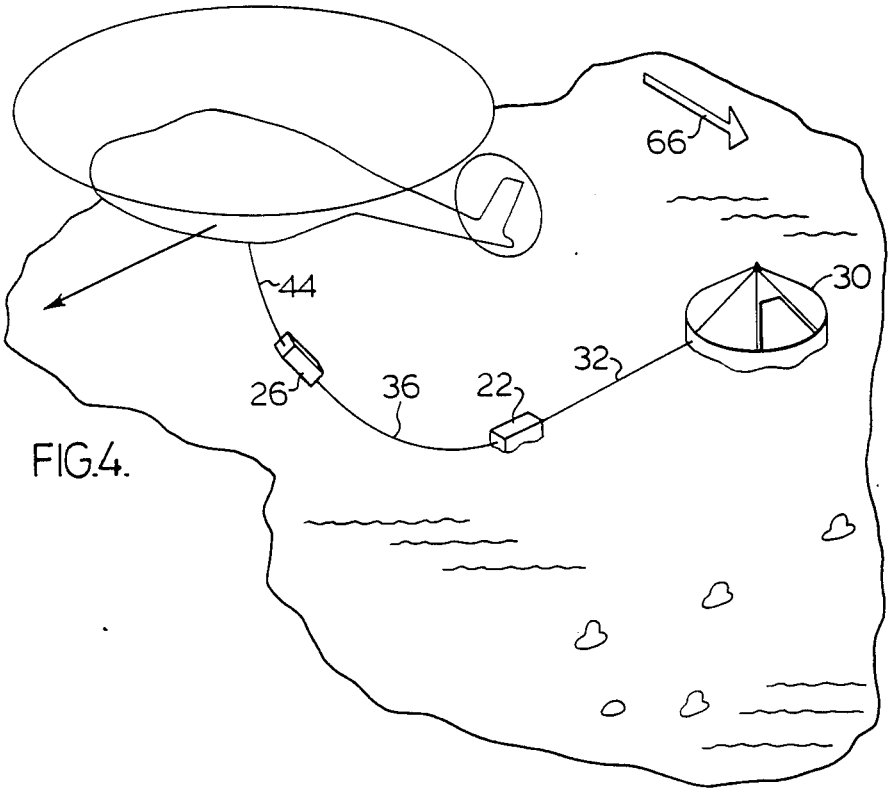
Figure 5:
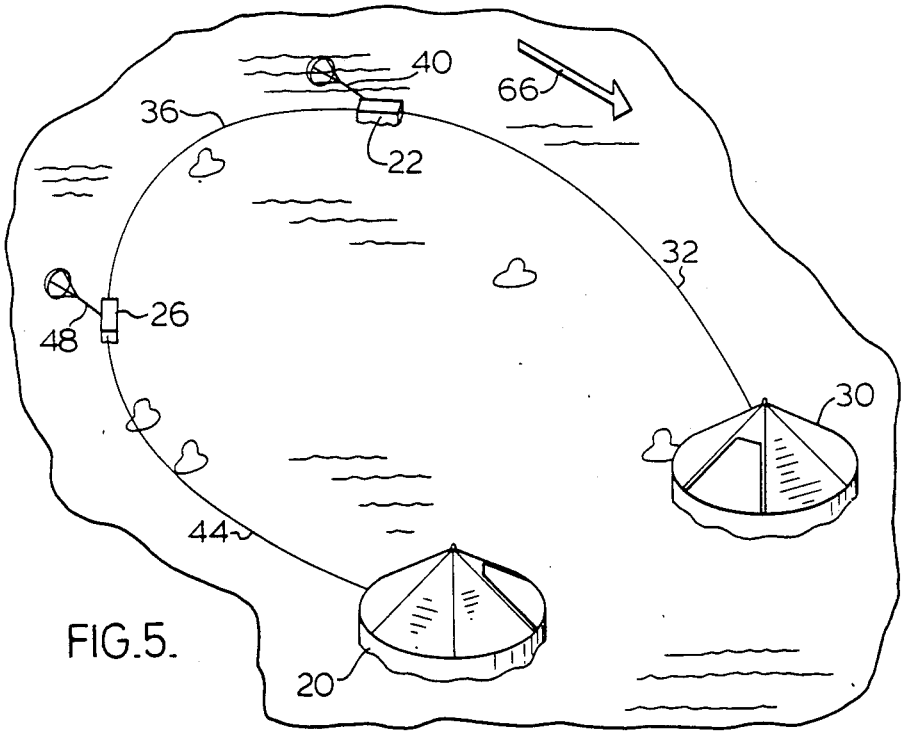

One embodiment of the invention will now be described by way of example, with reference to the accompanying drawings, in which:

FIG. 1 is a diagrammatic side view of a sea rescue kit,

FIG. 2 is diagrammatic view showing how the various items in the kit are secured together by the line, FIG. 3 is a diagrammatic plan view showing the manner in which the various rescue items are to be deployed from a helicopter, FIG. 4 is a diagrammatic view showing the various items being dropped, and FIG. 5 is a similar view showing the rescue items deployed in the sea around a group of casualties.

Referring to the drawings and initially to FIG. 1, a sea rescue for deployment from a helicopter comprises a container 12 which is a box-like construction with an open front. A second self-inflatable life raft 20 is located at the bottom of the container, a second survival kit 22 is positioned on a shelf 24 above the second raft 20, a first survival kit 26 is positioned on a shelf 28 above the second survival kit 22, and a first self-inflatable life raft 30 is located in front of the second survival kit 22 with its bottom rear edge resting on the front top edge of the second raft 20. The first raft 30 is held in place by a flexible strap 14 secured to the top and bottom of the container 12 by quick-release fasteners 16, 18. The front of the container 12 will normally be closed by a protective cover (not shown) which is removed before installation in a helicopter.

Referring now to FIG. 2, a first line portion 32 extends from the first raft 30 to the first survival kit 22, with the major part of the length of the first line portion 32 being stored in a quick-release manner in a chamber 34 in the raft 30 in a manner which will be readily apparent to a person skilled in the art. A second line portion 36 extends from the first survival kit 22 to the second survival kit 26, and the major part of the length of the second line portion 36 is stored in a quick-release manner in a chamber 38 in the first survival kit 22. A sea anchor line 40 extends from the part of the line portion 36 in chamber 38 to a sea anchor 42 secured to the survival kit 22 in a quick-release manner.

A third line portion 44 extends from the second survival kit 26 to the second life raft 20, and the major part of the length of the line portion 44 is stored in a quick-release manner in a chamber 46 in survival kit 26. A sea anchor line 48 extends from the part of the line portion 44 in chamber 46 to a sea anchor 50 secured to the survival kit 26 in a quick-release manner. A further line portion 52 extends from the second life raft 20 to an appropriate point in the container 12, and a major part of the length of the further line portion 52 is stored in a quick-release manner in a chamber 54 in the raft 20. The further line portion is connected to the container 12 by a weak link. The life rafts 30, 20, the survival kits 22, 26 and the sea anchors 42, 50 may be of known kind.

In use, and referring to FIG. 3 which shows a group of casualties 60 in the sea, the rescue kit is carried in a helicopter 62.

The helicopter 62 first drops two smoke flares 64 upwind of and on opposite sides of the casualties 60 at positions about 600 feet upwind and about 400 feet from the outsides of the group of casualties 60, the wind direction being shown by arrow 66. The flares 64 aid the subsequent procedure to be described.

The helicopter 62 is then manoeuvred to the position shown, namely hovering in a position upwind of the group of casualties 60 by about 300 feet and about 100 feet to the right of the casualties 60 facing upwind at a height of about 40 to 50 feet. The rescue kit is secured in position near an open doorway on the right-hand side of the helicopter.

By keeping an eye on one of the flares 64, the helicopter pilot moves the helicopter to the left along line 68 as the various kit items are deployed, such deployment being initiated by release of the quick-release fastening 16 to release the strap 14 from the open front of the container 12. The first life raft 30 then falls out of the helicopter 62 into the water and self-inflates. When the slack in the line portion 32 between the first raft 30 and the survival kit 22 has been taken up (with the line portion 32 first having been drawn out of chamber 34 in the raft 30), the first survival kit 22 is then pulled out of the container 12 and falls into the sea. Subsequently, the survival kit 26 is pulled out of the container 12 and into the sea when the second line portion 36 has tightened. Such tightening also causes tightening of the line 40 with the result that the sea anchor 42 is deployed. The second life raft 20 is pulled out of the container 12 and into the sea when the line portion 44 has tightened, at the same time causing the deployment of the second sea anchor 50.

The first raft 30, the first survival kit 22, the second survival kit 26 and the second raft 30 will thus have been deployed into the sea along the line 68 along which the helicopter 62 is moving sideways to the left during deployment. Also, the line portion 52 becomes taut and is pulled away from the container 12 on the helicopter 62 in a downward safe direction, the weak link between line 52 and container 12 having been broken.

The wind then causes the first and second rafts 30, 20 to drift downwardly past the casualties 60, with drift of the survival kits 22, 26 being retarded by the sea anchors 42, 50, with the result that the items deploy in a horseshoe shape around the casualties 60 as shown in FIG. 5. The casualties 60 can therefore readily reach the life rafts 30, 20 and climb aboard (assuming of course that they are physically able to do so), and thereafter haul up the survival kits 22, 26 and if desired rope the two life rafts 30, 20 together to await further rescue. The transverse movement of the helicopter 62 during deployment not only correctly initially positions the rafts and survival kits, but also minimizes any adverse affect on subsequent positioning of the items which might be caused by downwash from the helicopter rotor.

If desired, one or more of the various line portions 32, 36, 44 may be provided with one or two floats. Also, instead of being located in the helicopter 62, the container 12 may be carried externally of the helicopter, for example slung underneath, with the release being initiated by remote control from within the helicopter.

The described sea rescue kit can be deployed from a helicopter in winds up to about 70 or 80 knots with wave heights up to about 40 to 50 feet. Such a rescue kit may be suitable for twenty or thirty people and yet weigh only about 425 lbs. Each line portion may be of the order of 100 feet in length or longer.

It will also be readily apparent that the rescue items could also be dropped from the left-hand side of the helicopter by initially positioning the helicopter in a position to the left of the casualties and moving to the right during deployment.

Other embodiments of the invention will be readily apparent to a person skilled in the art, the scope of the invention being defined in the appended claims.

What I claim as new and desire to protect by Letters Patent of the United States is:

1. A sea rescue kit deployable from a helicopter comprising a first self-inflating life raft, a second self-inflating life raft, a line connecting the first and second life rafts, and means associated with the line to retard the line in the water relative to the life rafts to cause the life rafts and line to assume a substantially horse-shoe-shaped configuration around a predetermined position in the sea after deployment from a helicopter upwind of the predetermined position.

2. A sea rescue kit according to claim 1 including at least one floatable survival kit carried by the line.

3. A sea rescue kit according to claim 1 wherein said retarding means comprises at least one sea anchor.

4. A sea rescue kit according to claim 1 also including a container in which the first and second life rafts, the line and the retarding means are housed, and means retaining the life rafts, the line and the retarding means in the container, said first and second life rafts, the line and the retarding means being positioned in the container to cause the first life raft, the line, the retarding means and the second lift raft to leave the container by gravity and pull of the line when the retaining means is released.

* * * * *